US010159389B2

(12) United States Patent
Goeking et al.

(10) Patent No.: US 10,159,389 B2
(45) Date of Patent: Dec. 25, 2018

(54) SHEET PRODUCT DISPENSER WITH SENSOR FOR SHEET SEPARATION

(71) Applicant: GPCP IP Holdings LLC, Atlanta, GA (US)

(72) Inventors: Harold Goeking, Oshkosh, WI (US); Robert W. Cornell, Rothschild, WI (US); Panagiotis Zosimadis, Brampton (CA); Noah McNeely, Suwanee, GA (US)

(73) Assignee: GPCP IP Holdings LLC, Atlanta, GA (US)

( * ) Notice: Subject to any disclaimer, the term of this patent is extended or adjusted under 35 U.S.C. 154(b) by 928 days.

(21) Appl. No.: 13/897,428

(22) Filed: May 19, 2013

(65) Prior Publication Data

US 2013/0248644 A1 Sep. 26, 2013

Related U.S. Application Data

(63) Continuation of application No. 12/437,921, filed on May 8, 2009, now abandoned.

(51) Int. Cl.
*A47K 10/36* (2006.01)
*A47K 10/26* (2006.01)

(52) U.S. Cl.
CPC ..... *A47K 10/36* (2013.01); *A47K 10/26* (2013.01); *A47K 10/3612* (2013.01);
(Continued)

(58) Field of Classification Search
CPC ..... A47K 2010/36–2010/3881; A47K 10/36–10/3687; A47K 10/38; A47K 10/34; A47K 13/20
(Continued)

(56) References Cited

U.S. PATENT DOCUMENTS 3,133,466 A 5/1964 Seifert
3,628,743 A 12/1971 Bastian et al.
(Continued)

FOREIGN PATENT DOCUMENTS

CN 1316377 A 10/2001
DE 10115200 A1 10/2002
(Continued)

OTHER PUBLICATIONS

International Search Report and Written Opinion of the International Search Authority for PCT/US2010/033828 dated Jan. 18, 2011.
(Continued)

*Primary Examiner* — Jason Daniel Prone
*Assistant Examiner* — Samuel A Davies
(74) *Attorney, Agent, or Firm* — Eversheds Sutherland (US) LLP

(57) ABSTRACT

A sheet product dispenser is provided. The sheet product dispenser includes a roll of sheet product, a dispensing arrangement, and a method of sensing the separation of a dispensed sheet product. A sensor is provided for detecting the movement of a movable member, such as a tear bar or paper guide. The sensor generates a signal in response to the movement of the movable member. A controller de-energizes a roller in said dispensing arrangement in response to said signal.

18 Claims, 12 Drawing Sheets

(52) U.S. Cl.
CPC ..... *A47K 10/3625* (2013.01); *A47K 10/3687* (2013.01); *Y10T 83/896* (2015.04)

(58) Field of Classification Search
USPC ..... 83/372, 367, 365, 649, 650; 225/10, 12, 225/14, 15; 221/15, 303
See application file for complete search history.

(56) References Cited

U.S. PATENT DOCUMENTS

| | | | | |
|---|---|---|---|---|
| 3,866,056 | A | 2/1975 | Minniear et al. | |
| 4,067,509 | A | 1/1978 | Graham, Jr. et al. | |
| 4,165,138 | A | 8/1979 | Hedge et al. | |
| 4,260,117 | A | 4/1981 | Perrin et al. | |
| 4,378,912 | A | 4/1983 | Perrin et al. | |
| 4,676,131 | A * | 6/1987 | Cassia | A47K 10/3643 83/208 |
| 5,203,036 | A * | 4/1993 | Juushi | A47K 13/20 4/243.1 |
| 5,294,192 | A | 3/1994 | Omdoll et al. | |
| 5,526,973 | A | 6/1996 | Boone et al. | |
| 5,558,302 | A | 9/1996 | Jesperson | |
| 5,735,324 | A * | 4/1998 | Ponce | B23D 59/001 144/216 |
| 5,758,982 | A | 6/1998 | Yoshida et al. | |
| 5,934,167 | A | 8/1999 | Yamamoto | |
| 6,079,305 | A | 6/2000 | Bloch et al. | |
| 6,334,587 | B1 | 1/2002 | Roder | |
| 6,354,533 | B1 | 3/2002 | Jespersen | |
| 6,370,844 | B1 | 4/2002 | Stricker | |
| 6,412,726 | B2 | 7/2002 | Inana et al. | |
| 6,419,136 | B2 | 7/2002 | Formon et al. | |
| 6,592,067 | B2 | 7/2003 | Denen et al. | |
| 6,736,348 | B1 | 5/2004 | Formon et al. | |
| 6,820,785 | B2 | 11/2004 | Kapiloff | |
| 6,826,985 | B2 | 12/2004 | Broehl | |
| 6,826,991 | B1 | 12/2004 | Rasmussen | |
| 6,854,684 | B2 | 2/2005 | Byrd et al. | |
| 6,892,620 | B2 | 5/2005 | Kapiloff | |
| 6,903,654 | B2 | 6/2005 | Hansen et al. | |
| 6,962,451 | B2 | 11/2005 | Narita et al. | |
| 6,977,588 | B2 | 12/2005 | Schotz et al. | |
| 6,994,408 | B1 * | 2/2006 | Bunnell | A47K 10/36 312/34.8 |
| 7,044,421 | B1 * | 5/2006 | Omdoll | A47K 10/36 242/563 |
| 7,237,744 | B2 | 7/2007 | Morris et al. | |
| 7,270,292 | B2 | 9/2007 | Rasmussen | |
| 2002/0109036 | A1 | 8/2002 | Denen et al. | |
| 2002/0117578 | A1 | 8/2002 | Denen et al. | |
| 2003/0116003 | A1 | 6/2003 | Kapiloff | |
| 2003/0168489 | A1 | 9/2003 | Formon et al. | |
| 2003/0177850 | A1 | 9/2003 | Whittington | |
| 2004/0099678 | A1 | 5/2004 | Windorski et al. | |
| 2005/0145745 | A1 | 7/2005 | Lewis et al. | |
| 2005/0167541 | A1 | 8/2005 | Osborne | |
| 2005/0171634 | A1 | 8/2005 | York et al. | |
| 2005/0220462 | A1 | 10/2005 | Miyaji | |
| 2006/0000335 | A1 * | 1/2006 | Chen | A47K 10/3612 83/649 |
| 2006/0169827 | A1 | 8/2006 | Lewis et al. | |
| 2006/0173576 | A1 | 8/2006 | Goerg et al. | |
| 2007/0246580 | A1 * | 10/2007 | Matlin | B02C 18/0007 241/30 |
| 2008/0078777 | A1 * | 4/2008 | Cittadino | A47K 10/36 221/1 |
| 2009/0151526 | A1 * | 6/2009 | Chiba | B26D 1/385 83/346 |
| 2010/0286817 | A1 | 11/2010 | Goeking et al. | |
| 2011/0253829 | A1 | 1/2011 | Goeking et al. | |
| 2013/0079923 | A1 * | 3/2013 | Cittadino | A47K 10/36 700/232 |

FOREIGN PATENT DOCUMENTS

| | | | | |
|---|---|---|---|---|
| EP | 1297770 | A1 | 4/2003 | |
| EP | 1405590 | A1 | 4/2004 | |
| WO | 2003/051166 | A1 | 6/2003 | |
| WO | 2007/039790 | A1 | 4/2007 | |
| WO | WO 2007039790 | A1 * | 4/2007 | A47K 10/36 |
| WO | 2009/055473 | A1 | 4/2009 | |

OTHER PUBLICATIONS

International Search Report and Written Opinion of the International Search Authority for PCT/US2010/033829 dated Jan. 18, 2011.
Office Action for U.S. Appl. No. 12/437,974 dated Mar. 29, 2012.
Office Action for U.S. Appl. No. 12/437,974 dated Dec. 27, 2012.
Office Action received for Canadian Patent Application No. 2,760,545, issued by the Canadian Intellectual Property Office dated Feb. 5, 2016.

* cited by examiner

SHEET PRODUCT DISPENSER WITH SENSOR FOR SHEET SEPARATION

CROSS-REFERENCE TO RELATED APPLICATIONS

This application is a continuation of U.S. patent application Ser. No. 12/437,921, filed May 8, 2009, which is incorporated herein by reference in its entirety.

BACKGROUND OF THE INVENTION

The present invention relates generally to a sheet product dispenser, and in particular to a sheet product dispenser having a sensor for detecting the separation of a sheet product from the dispenser.

Sheet product dispensers typically include rolls of sheet product. The sheet product is dispensed from the roll by passing one end of the sheet product through a pair of rollers. One of the rollers is coupled to an electric motor that is selectively energized by a controller. Friction between the rollers and the sheet product pulls the sheet product from the sheet product roll when the motor is operated. Some type of separation arrangement is also provided for allowing a portion of the sheet product roll to be removed from the dispenser by a user.

The separation arrangement may be provided in several ways. The sheet product may include perforations for example. When sheet product with perforations is used, the dispenser includes a means for positioning the perforations adjacent to the opening where the sheet product is dispensed. The perforations allow the sheet product dispensed to the user to separate when the user pulls on the sheet product.

Alternatively, or in conjunction with the perforations, the dispenser may also have a cutting arrangement, in this arrangement, a cutting device, commonly referred to as a tear bar, is positioned adjacent the opening where the sheet product is dispensed. The tear bar may be a sharp blade, or a serrated blade. The tear bar is positioned such that when the user pulls on the dispensed sheet product, the sheet product engages the tear bar. This action results in the sheet product being cut or torn allowing the user to remove the dispensed portion.

Generally, the sheet product dispenser includes a controller for performing and controlling the functional operations of the dispenser. The dispenser may control the amount of sheet product dispensed in several ways. One means of controlling the amount of dispensed sheet product is by timing the operation of the motor coupled to the rollers.

While existing sheet product dispensers are suitable for their intended purposes, there still remains a need for improvements particularly regarding the detection of when the dispensed sheet product has been separated from the dispenser. Further, there is also a need for improvements that minimize waste while providing consistent dispensing of sheet product for an end user.

SUMMARY OF THE INVENTION

In accordance with one embodiment of the invention, a sheet product dispenser for dispensing a sheet product disposed therein is provided. The sheet product dispenser includes a housing with a sheet-dispensing opening. A tear bar is positioned adjacent the opening and with an edge disposed for tearing the sheet product upon dispensing. A movable member is arranged to interact with the sheet product. A biasing member is operably coupled to the movable member. A sensor is configured for transmitting a signal in response to movement of the movable member.

In accordance with another embodiment of the invention, a sheet product dispenser is provided. The sheet product dispenser includes a housing. A sheet dispenser roller is coupled in the housing. A tear bar edge is operably coupled to the housing. A movable member is positioned adjacent the sheet dispenser roller. A biasing member is operably coupled to the movable member. A tear sensor is operably coupled to the movable member. A proximity sensor is mounted to the housing. A controller is electrically coupled to the sheet dispenser roller and the tear sensor. The controller is responsive to executable computer instructions for actuation of the sheet dispenser in response to a signal from the proximity sensor and deactivates the sheet dispenser in response to a signal from the tear sensor.

In accordance with another embodiment of the invention, a method of dispensing a sheet product is provided. The method includes the steps of activating a dispensing roller. A sheet product is dispensed with the dispensing roller. The sheet product is separated from a housing with a tear bar. A movable member is moved, wherein the movement is in response to the sheet product being separated from the housing. A signal is transmitted to a controller indicating the movement of the movable member. The dispensing roller is deactivated in response to the signal.

BRIEF DESCRIPTION OF THE DRAWINGS

Referring now to the drawings, which are meant to be exemplary and not limiting, and wherein like elements are numbered alike.

DETAILED DESCRIPTION

Figure 1:
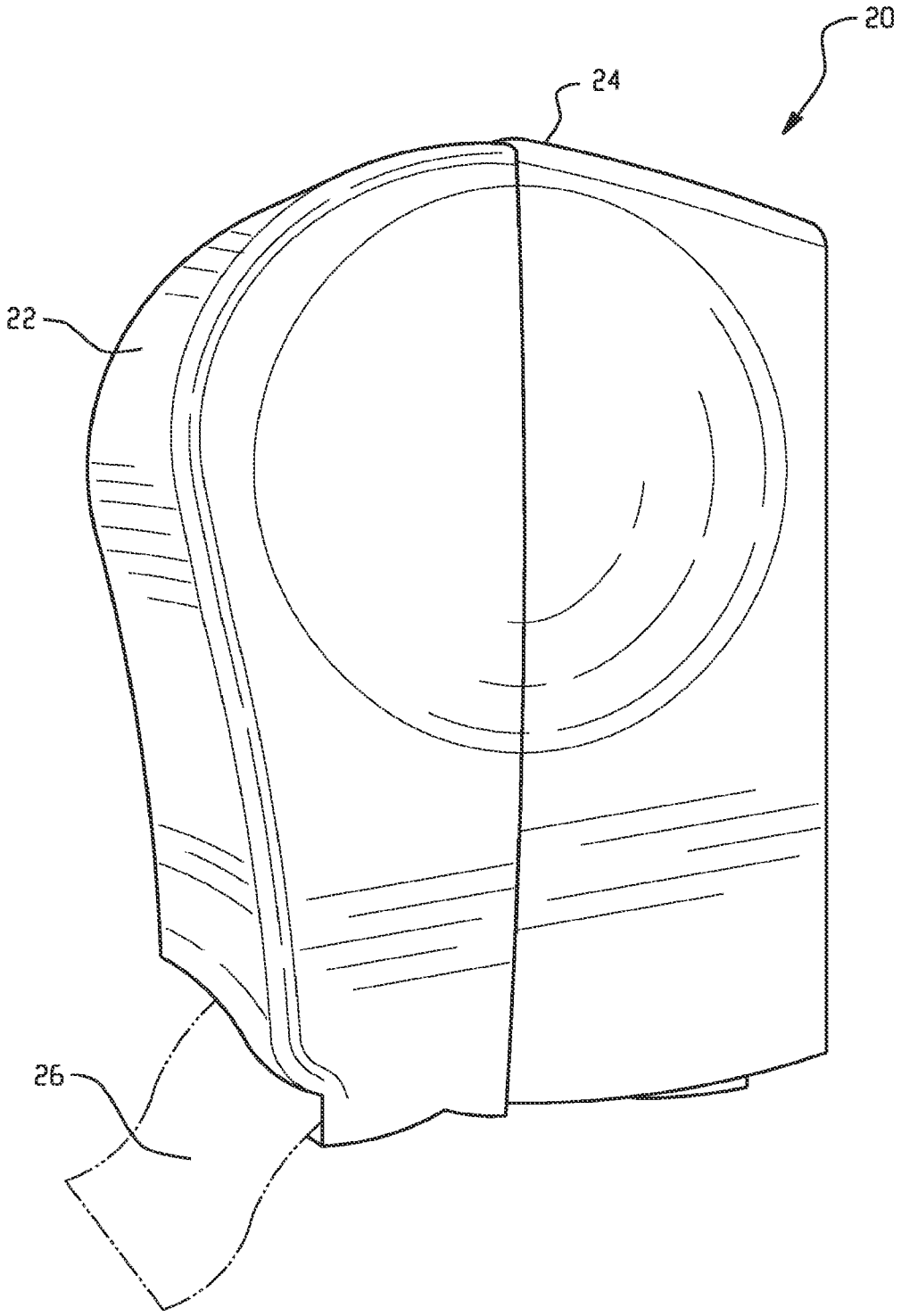
FIG. 1 is a perspective view illustration of a sheet product dispenser in accordance with an exemplary embodiment of the invention.
Figure 2:
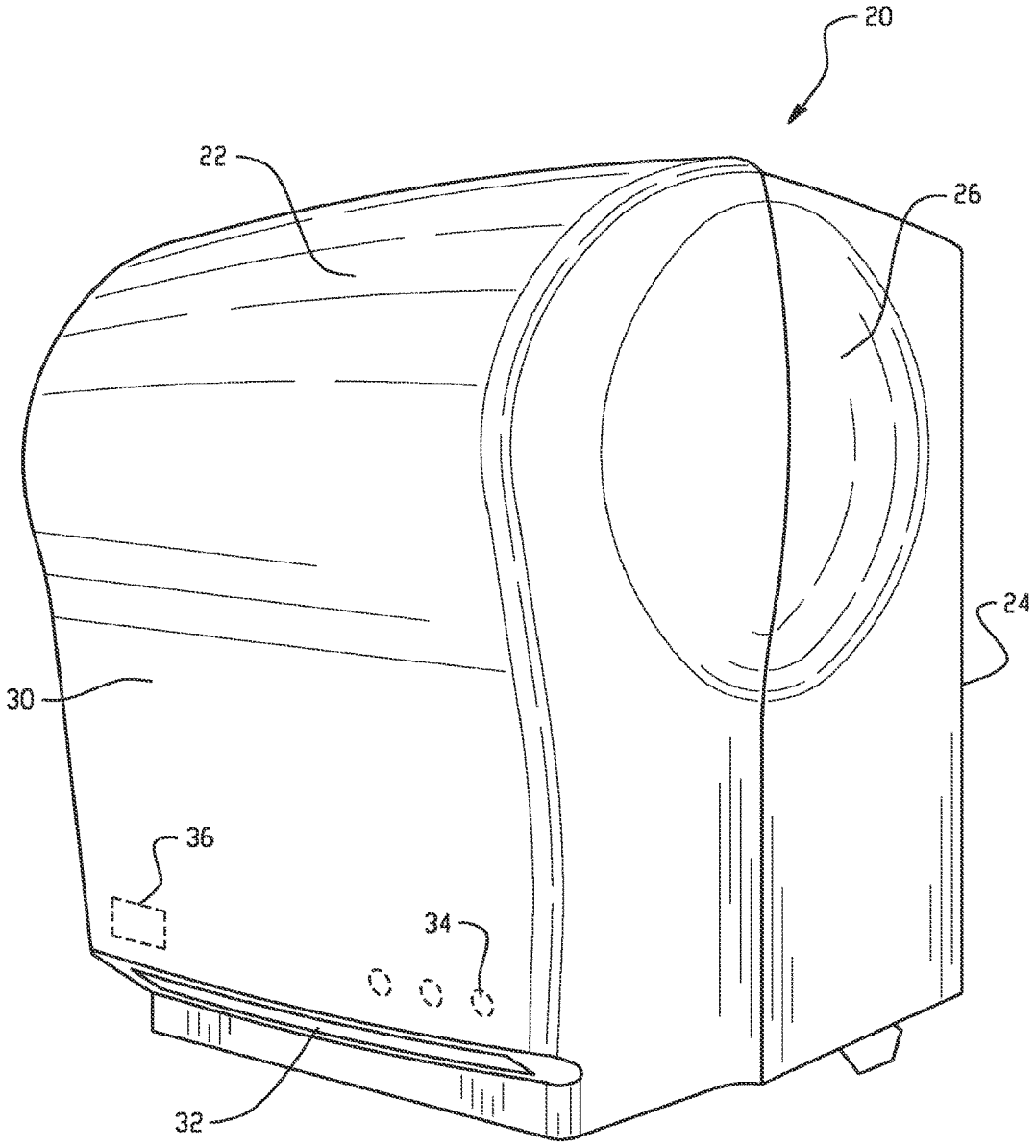
FIG. 2 is a perspective view illustration of the sheet product dispenser of FIG. 1.
Figure 3:
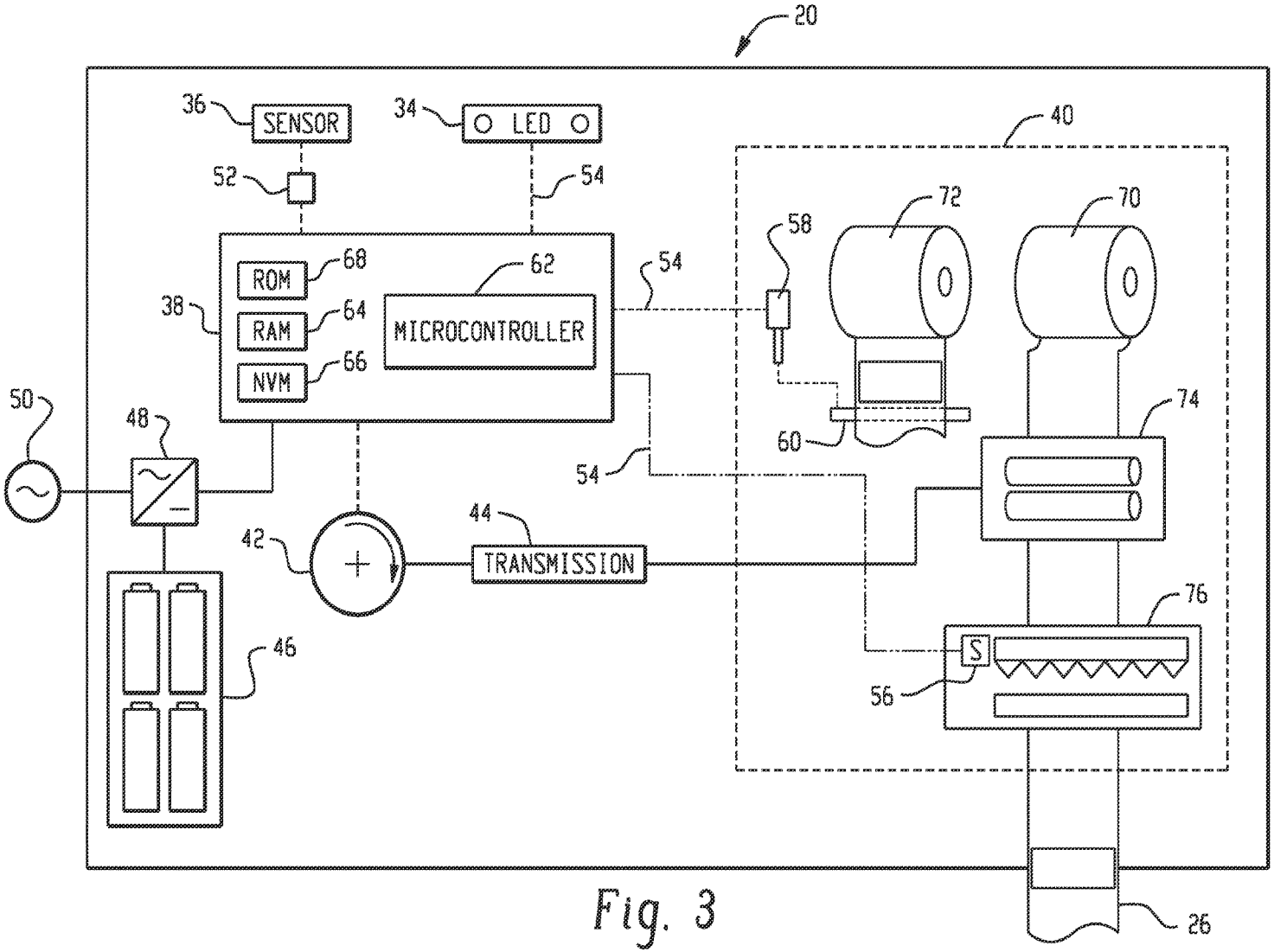
FIG. 3 is a schematic view illustration of the sheet product dispenser of FIG. 1.

FIG. 1-FIG. 3 illustrate an exemplary embodiment of a sheet product dispenser 20. The sheet product dispenser 20 includes a front cover 22 and a back plate 24 that is arranged to hold and dispense a sheet product 26. The term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from the roll at discrete intervals. Individual sheets may be sized as desired to accommodate the many uses of the sheet products. For example, perforation lines may be formed every 13 inches to define a universally sized sheet. Multiple perforation lines may be provided to allow the user to select the size of sheet depending on the particular need.

The sheet product dispenser 20 may include an enlarged portion 28 that provides room in the interior of the sheet product dispenser 20 for a full roll of sheet product. The front cover 22 may be formed from any suitable material, such as a plastic, that is cost effective and meets the environmental requirements of the application. In the exemplary embodiment, the front cover 22 may be opaque, translucent or tinted. If the front cover 22 is translucent, it may provide advantages in allowing maintenance personnel to quickly determine the quantity of sheet product 26 remaining in the sheet product dispenser 20. In one embodiment, the sheet product dispenser 20 is water proof or water resistant, which allows the sheet dispenser to be used in wet environments, such as a food processing facility for example.

The general shape of the sheet product dispenser 20 is arranged to minimize the size of the sheet product dispenser 20, wherein the front cover 22 includes a tapered portion 30. The tapered portion 30 is located adjacent the dispensing slot 32. This tapering reduces the interior volume of the lower portion of the sheet product dispenser 20. The sheet dispenser may include one or more light-emitting-diodes (LED's) 34 to provide a visual indication as to the status of the sheet dispenser. A proximity sensor 36 is also positioned adjacent the front cover 22 near the slot 32. The proximity sensor 36 may be any suitable sensor, such as an infrared sensor for example, that is capable of sensing the presence of a user's hand in front of the sheet product dispenser 20.

A schematic representation of the major components of the sheet product dispenser 20 is shown in FIG. 3. It should be appreciated that the illustration in FIG. 3 is for purposes of description and that the relative size and placement of the respective components may differ. The sheet product dispenser 20 includes a main controller 38. As will be described in more detail herein, the main controller 38 provides logic and control functionality used during operation of the sheet product dispenser 20. Alternatively, the functionality of the main controller 38 may be distributed to several controllers that each provides more limited functionality to discrete portions of the operation of sheet product dispenser 20. The main controller 38 is coupled to a dispensing mechanism 40 to dispense a sheet product 26 when activated by a user. A motor 42 and an optional transmission assembly 44 drive the dispensing mechanism 40. The optional transmission assembly 44, such as a gearbox for example, adapts the rotational output of the motor 42 for the dispensing of the sheet product 26.

In the exemplary embodiment, the electrical energy for operating the sheet product dispenser 20 is provided by a battery 46, which may be comprised of one or more batteries arranged in series or in parallel to provide the desired energy. To minimize maintenance costs, it is desirable that the amount of stored energy allows for the dispensing of 48,000 feet of sheet product. In the exemplary embodiment, the battery 46 includes four 1.5-volt "D" cell batteries. The battery 46 is connected to the main controller 38 via an optional power converter 48 that adapts the electrical output of the battery 46 to that desired for operating the sheet product dispenser 20. The optional power converter 48 may also accept an input from an external power source, such as an alternating current ("AC") power source 50. The AC power source 50 may be any conventional power source, such as a 120V, 60 Hz wall outlets for example.

The main controller 38 is a suitable electronic device capable of accepting data and instructions, executing the instructions to process the data, and presenting the results. Main controller 38 may accept instructions through a user interface, or through other means such as but not limited to a proximity sensor, voice activation means, manually-operable selection and control means, radiated wavelength and electronic or electrical transfer. Therefore, main controller 38 can be, but is not limited to a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, acellular computer, a solid-state computer, a single-board computer, a buffered computer, a computer network, a desktop computer, a laptop computer, a personal digital assistant (PDA) or a hybrid of any of the foregoing.

Main controller 38 is capable of converting the analog voltage or current level provided by sensors, such as proximity sensor 36 for example, into a digital signal indicative of a user placing their hand in front of the sheet product dispenser 20. Alternatively, proximity sensor 36 may be configured to provide a digital signal to main controller 38, or an analog-to-digital (A/D) converter 52 maybe coupled between proximity sensor 36 and main controller 38 to convert the analog signal provided by proximity sensor 36 into a digital signal for processing by main controller 38. Main controller 38 uses the digital signals as input to various processes for controlling the sheet product dispenser 20. The digital signals represent one or more sheet product dispenser 20 data including but not limited to proximity sensor activation, stub roll empty, tear bar activation, motor current, motor back electromotive force, battery level and the like.

Main controller 38 is operably coupled with one or more components of sheet product dispenser 20 by data transmission media 54. Data transmission media 54 includes, but is not limited to, solid-core wiring, twisted pair wiring, coaxial cable, and fiber optic cable. Data transmission media 54 also includes, but is not limited to, wireless, radio and infrared signal transmission systems. Main controller 38 is configured to provide operating signals to these components and to receive data from these components via data transmission media 54. Main controller 38 communicates over the data transmission media 54 using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The main controller 38 may also accept data from sensors, such as tear bar sensor 56 for example, and devices such as motor 42 and electromechanical actuator 58 for example. Main controller 38 is also given certain instructions from an executable instruction set for the purpose of comparing the data from tear bar sensor 56 to predetermined operational parameters.

Main controller 38 includes a processor 62 coupled to a random access memory (RAM) device 64, a non-volatile memory (NVM) device 66, and a read-only memory (ROM) device 68. Main controller 38 may optionally be connected to one or more input/output (I/O) controllers or data interface devices (not shown). NVM device 66 is any form of non-volatile memory such as an EPROM (Erasable Programmable Read Only Memory) chip, a flash memory chip, a disk drive, or the like. Stored in NVM device 66 are various operational parameters for the application code. It should be recognized that application code could be stored in NVM device 66 rather than ROM device 68.

Main controller 38 includes operation control methods embodied in application code. These methods are embodied in computer instructions written to be executed by processor 62, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

The dispensing mechanism 40 may further include a transfer bar 60 that is activated by an electromechanical actuator 58. The transfer bar acts to move the end portion of sheet product 26 on main roll 72 from a first position to a second position where it engages the rollers in roller assembly 74 and may thereafter be dispensed. In one embodiment, the electromechanical actuator 58 is a solenoid having a wound coil core and a movable plunger. The plunger moves in response to the core being energized. A spring, or other similar device may be used to return the plunger to its original position once the core is de-energized. The electromechanical actuator 58 may also be a rotary solenoid, a motor, a shape metal alloy, an electro-magnet, or a piezoelectric device for example. The core is electrically coupled to the main controller 38.

The exemplary dispensing mechanism 40 also includes at least two sheet products 70, 72 that are mounted on rolls or core stock. Maintenance personnel manually refill the sheet product dispenser 20 and position stub roll 70 within the lower or tapered portion 30. This stub roll 70 is commonly referred to as a "stub roll" since it usually, but not necessarily, contains only a portion of the sheet product of a new/full sheet product roll. However, in one embodiment the stub roll 70 can be a new or full sheet product roll. Since the stub roll 70 has less sheet product, it is able to fit within the lower portion of the sheet product dispenser 20. The stub roll 70 feeds sheet product to a roller assembly 74 that includes a pair of rollers that pull the sheet product when activated by motor 42. A tear bar assembly 76 is positioned adjacent the dispensing slot 32 to provide a means for separating the dispensed sheet product 26 from the stub roll 70.

After the roller assembly 74 pulls the sheet product from either the stub roll 70 or the main roll 72, the sheet product proceeds to tear bar assembly 76. The tear bar assembly 76 is positioned adjacent the dispensing slot 32. A means for cutting the sheet product 26 is included in tear bar assembly 76 once the appropriate amount of sheet product 26 has been dispensed. As will be discussed in more detail below, the tear bar assembly 76 may separate the dispensed sheet product using a sharp edge that cuts into the sheet when the user pulls the dispensed sheet product 26. The separation of the sheet product 26 from the sheet product roll 70, 72 may then be used and discarded as necessary by the user.

A tear bar sensor 56 is positioned adjacent to the tear bar assembly 76. As will be described in more detail herein, the tear bar sensor 56 provides a signal to the main controller 38 that indicates whether the dispensed portion of sheet product has been separated from the sheet product dispenser 20. It should be appreciated that the detection of the sheet product being separated by the tear bar assembly 76 provides a positive feedback to the main controller 38 to de-energize the motor 42. Thus the sheet product dispenser 20 may avoid waste and the related increased costs.

Figure 4:
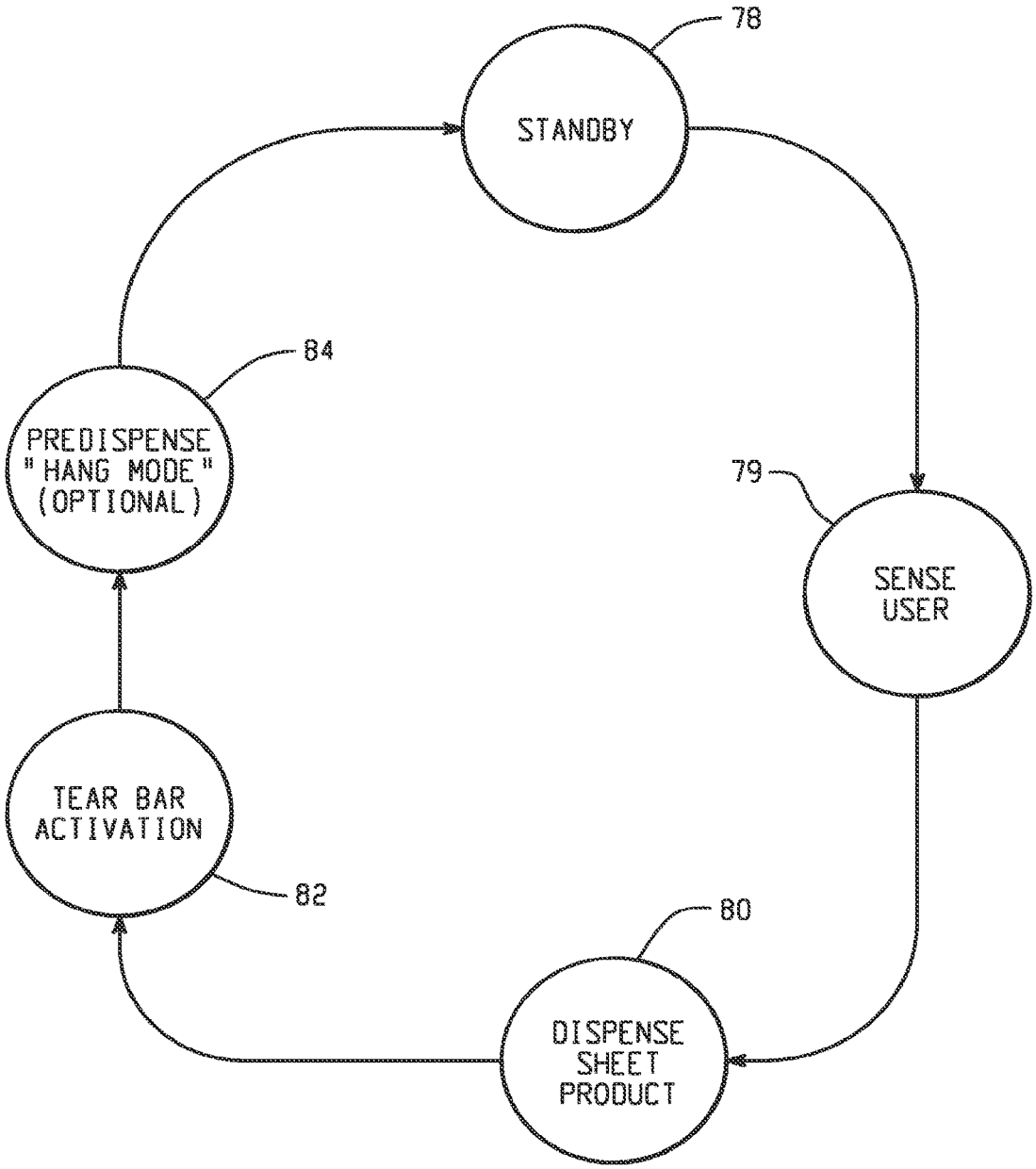
FIG. 4 is a block diagram illustration of the modes of operation for the sheet product dispenser of FIG. 1.
Figure 5:
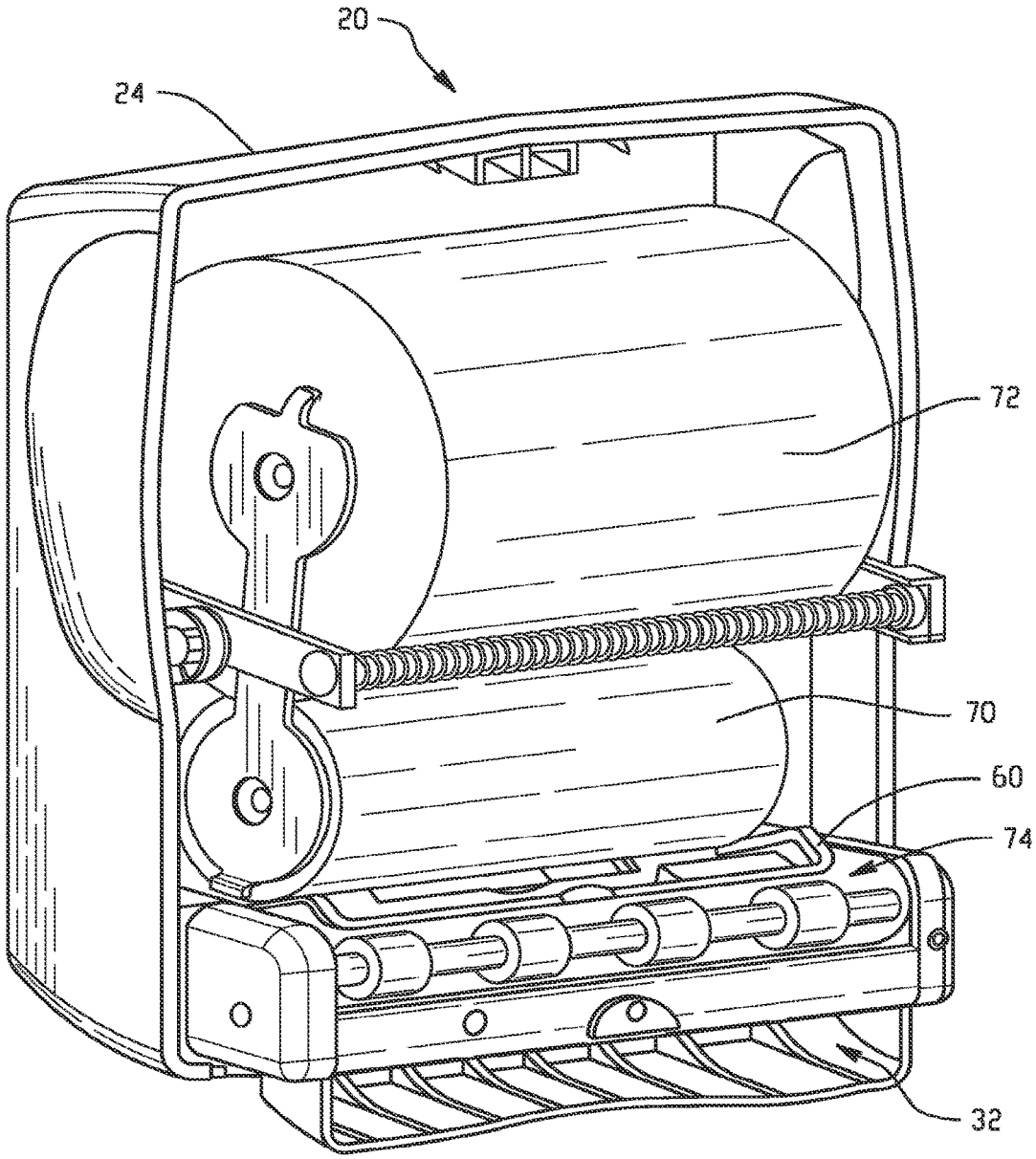
FIG. 5 is a perspective view illustration of the sheet product dispenser of FIG. 1 with the front cover removed.
Figure 6:
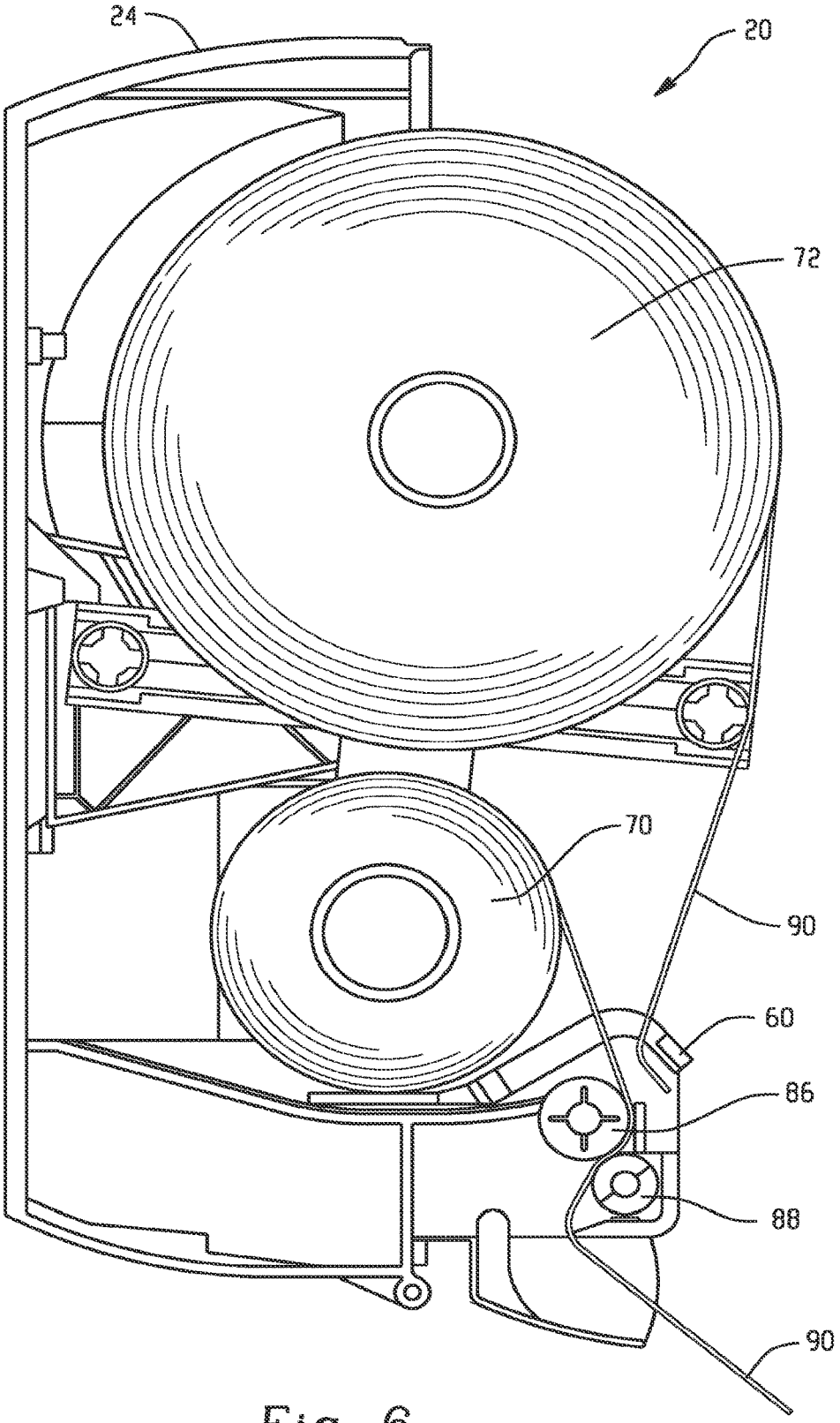
FIG. 6 is a side plan view illustration of the sheet product dispenser of FIG. 1 with the front cover removed.

The operation of the sheet product dispenser 20 may be thought of as a series of operational modes as shown in FIG. 4, The first mode, or "Standby Mode" 78 is the mode or operation that sheet product dispenser 20 operates a majority of the time. In one embodiment, the sheet product dispenser 20 in standby mode 78 may minimize energy usage a preserve battery life. Once the proximity sensor 36 provides an indication that a user needs sheet product 26, the sheet product dispenser 20 enters "Activation" mode 79. In this mode 80, the main controller 38 determines if a user is triggering the proximity sensor 36 and initiates operation of the sheet product dispenser 20.

The sheet product dispenser 20 then enters "Dispensing" mode 82. In this "Dispensing" mode 82, the sheet product dispenser 20 activates components within the sheet product dispenser 20, such as the motor 42 by drawing electrical power from the battery 46 for example. Once the user has received a sufficient amount of sheet product, the user will pull on the sheet product causing the dispensed portion of the sheet product 26 to separate from the sheet product roll 70, 72. The separation of the dispensed sheet product activates tear bar sensor 56 causing the sheet product dispenser 20 to enter "Tear" mode 82.

In tear mode 82, the main controller 38 may take several actions depending on the configuration of sheet product dispenser 20. In one embodiment, upon activation of the tear bar sensor 56, the main controller 38 de-energizes the motor 42. This stops the rotation of the roller assembly 74, halting the dispensing of sheet product 26 from the sheet product roll 70, 72, Alternatively, the main controller 38 may operate the roller assembly 74 for a predetermined number of turns to allow the leading edge of the sheet product 26 to advance into the dispensing slot 32. In another alternate embodiment, the sheet product dispenser 20 enters optional "Predispense" mode 84. Predispense mode 84 advances the leading edge of the sheet product beyond the opening where the sheet product 26 exits to allow a full-dispensed sheet portion to be exposed to a user and immediately available for use. Pre-dispense mode 84 is sometimes referred to as "Hang Mode."

An exemplary embodiment sheet product dispenser 20 is shown in FIGS. 5-8. In this embodiment, the stub roll 70 and main roll 72 are arranged with the main roll 72 being in the upper portion and the stub roll 70 in the lower portion of sheet product dispenser 20. The roller assembly 74 includes a feed roller 86 and a pinch roller 88. The location where the rollers meet is commonly referred to as the "nip." The feed roller 86 is coupled for rotation to the motor 42. When maintenance or refill operations are performed on the sheet product dispenser 20, the stub roll 70 is positioned in the lower portion and the leading edge portion 90 of the sheet product 26 from stub roll 70 is inserted between the feed roller 86 and the pinch roller 88 at the nip. Friction between the rollers 86 and 88 and the sheet product 26 causes sheet product 26 to be pulled from the stub roll 70 when the motor 42 is activated. Maintenance personnel may also position the main roll 72 in the sheet product dispenser 20. The main roll 72 includes a leading edge portion 90 that is positioned adjacent the transfer bar 60. An arm on the transfer bar 60 extends parallel to the feed roller 86 transversely across the front of the sheet product dispenser 20 to engage the main roll leading edge portion 90.

Figure 7:
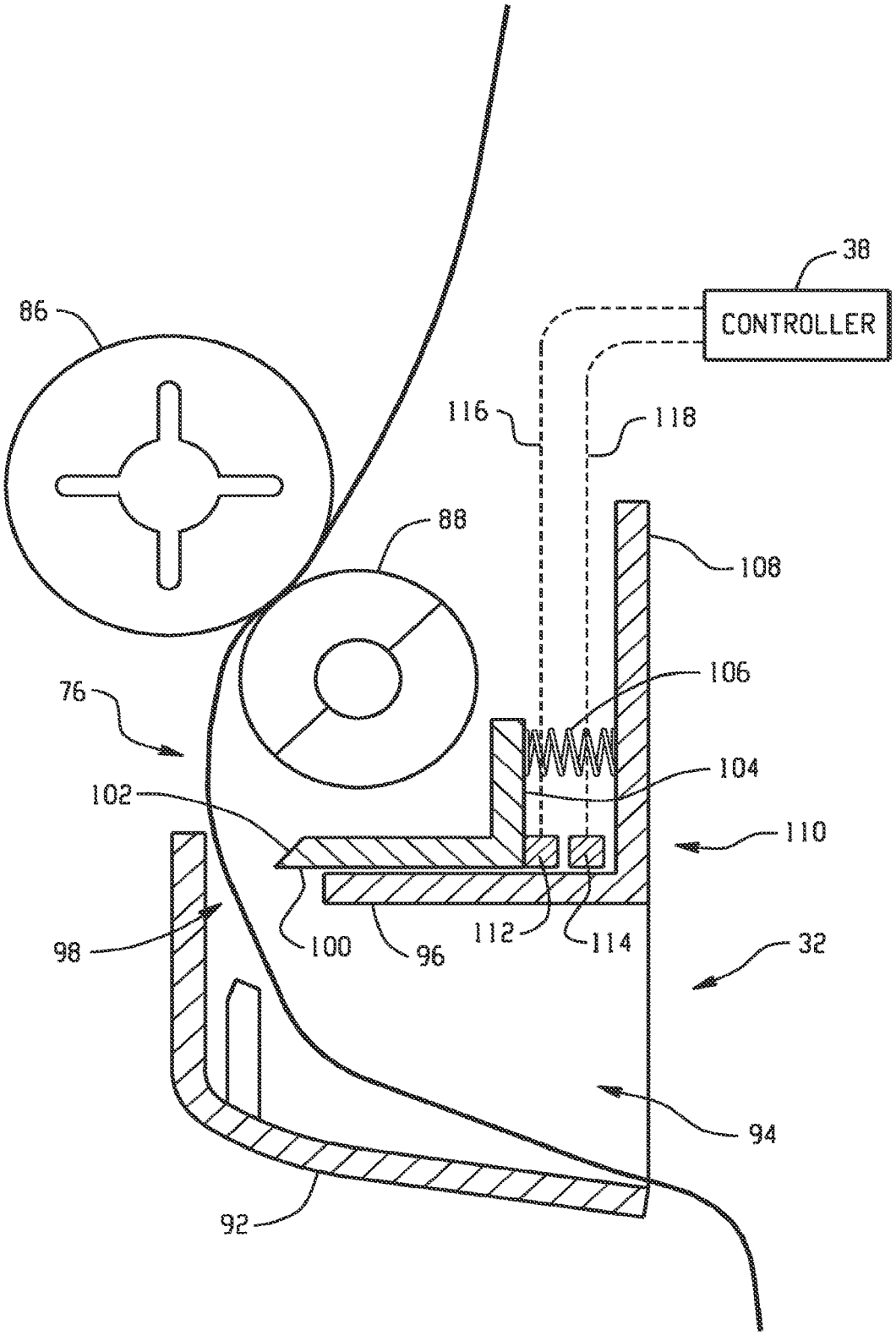
FIG. 7 is a partial side plan view illustration of the sheet product dispenser of FIG. 1 with an exemplary embodiment tear bar and tear bar sensor.

In the exemplary embodiment, the tear bar assembly 76 is positioned adjacent to the dispensing slot 32 as illustrated in FIG. 7. The leading edge 90 passes through the rollers 86, 88 and into the dispensing slot 32. The dispensing slot 32 is the portion of the sheet product dispenser 20 where the sheet product 26 exits and is accessible to the user. The housing 24 includes a curved surface 92 that is arranged along the bottom of the housing 24 and provides a means for guiding the sheet product from the rollers 86, 88 to the opening 94 of the dispensing slot 32. Opposite the surface 92 the housing 24 includes a projection 96 that extends generally perpendicular from the front of the housing 24 back towards the rollers 86, 88. The curved surface 92 and the projection 96 cooperate to form an opening 98 at the entrance to the dispensing slot 32.

In the exemplary embodiment illustrated in FIG. 7, a tear bar 100 is slidably coupled to the projection 96. The tear bar 100 may be slidably fixed to the projection 96 by any suitable means, such as by having threaded fasteners captured in slots for example. As will be discussed in more detail below, the tear bar 100 is arranged to move in a direction parallel to the projection 96. The tear bar 100 further includes a blade edge 102 that is positioned adjacent the opening 98 and adjacent the path of the sheet product leading edge portion 90. The blade edge 102 may be a knife-edge, a serrated edge or any other suitable edge capable of cutting the sheet product leading edge portion 90 from the sheet product roll 70, 72, The tear bar 100 also includes a back surface 104 opposite edge 102. An elastic member 106, such as a compression spring for example, is positioned between the back surface 104 and wall 108. Wall 108 may be part of the tapered portion 30, or an extension of the projection 96. In either case, the wall 108 provides a relatively fixed location allowing the spring 106 to bias the tear bar 100 towards the opening 98.

Tear bar assembly 76 also has a sensor 110 that includes a first electrical contact 112 and a second electrical contact 114. The first electrical contact 112 is coupled to the back surface 104 of tear bar 100 and is arranged to move with the tear bar 100. The second electrical contact 114 is positioned in a fixed arrangement relative to the housing 24. In the exemplary embodiment, the second electrical contact 114 is coupled to the projection 96. In an alternate embodiment, the second electrical contact 114 is coupled to the wall 108. Electrical conductors 116, 118 electrically couple the first electrical contact 112 and the second electrical contact 114 to the main controller 38 respectively.

During operation, the sheet product dispenser 20 provides sheet product 26 to the user via dispensing slot 32. Once a sufficient amount of sheet product 26 exits the sheet product dispenser 20, the user pulls on the sheet product causing the sheet product in the opening 98 to engage the edge 102 of tear bar 100, Since the tear bar 100 is slidably mounted, the tear bar 100 moves under the force of sheet product being pulled by the user. The tear bar 100 continues to move until the first electrical contact 112 comes into contact with the second electrical contact 114. The electrical contact of the electrical contacts 112, 114 stops any further travel by the tear bar 100. An edge 102 thereafter completes the cutting of the sheet product, allowing the user to remove the separated sheet.

The contact of the electrical contacts 112, 114 also completes an electric circuit formed by the electrical contacts 112, 114, the electrical conductors 116, 118 and the main controller 38. The completion of this circuit allows a signal to be transmitted to the main controller 38 indicating that the tear bar 100 has been moved. From this signal, the main controller 38 may infer that the sheet product 26 has been separated and that the dispensing cycle is completed. As discussed above, the main controller 38 may be configured in several ways, such as deactivating or stopping the feed roller 86 immediately upon activation of the tear bar 100 for example. Alternatively, the main controller 38 may operate for a short period of time until the leading edge portion 90 of the sheet product 26 is adjacent the opening 94 for example.

Figure 8:
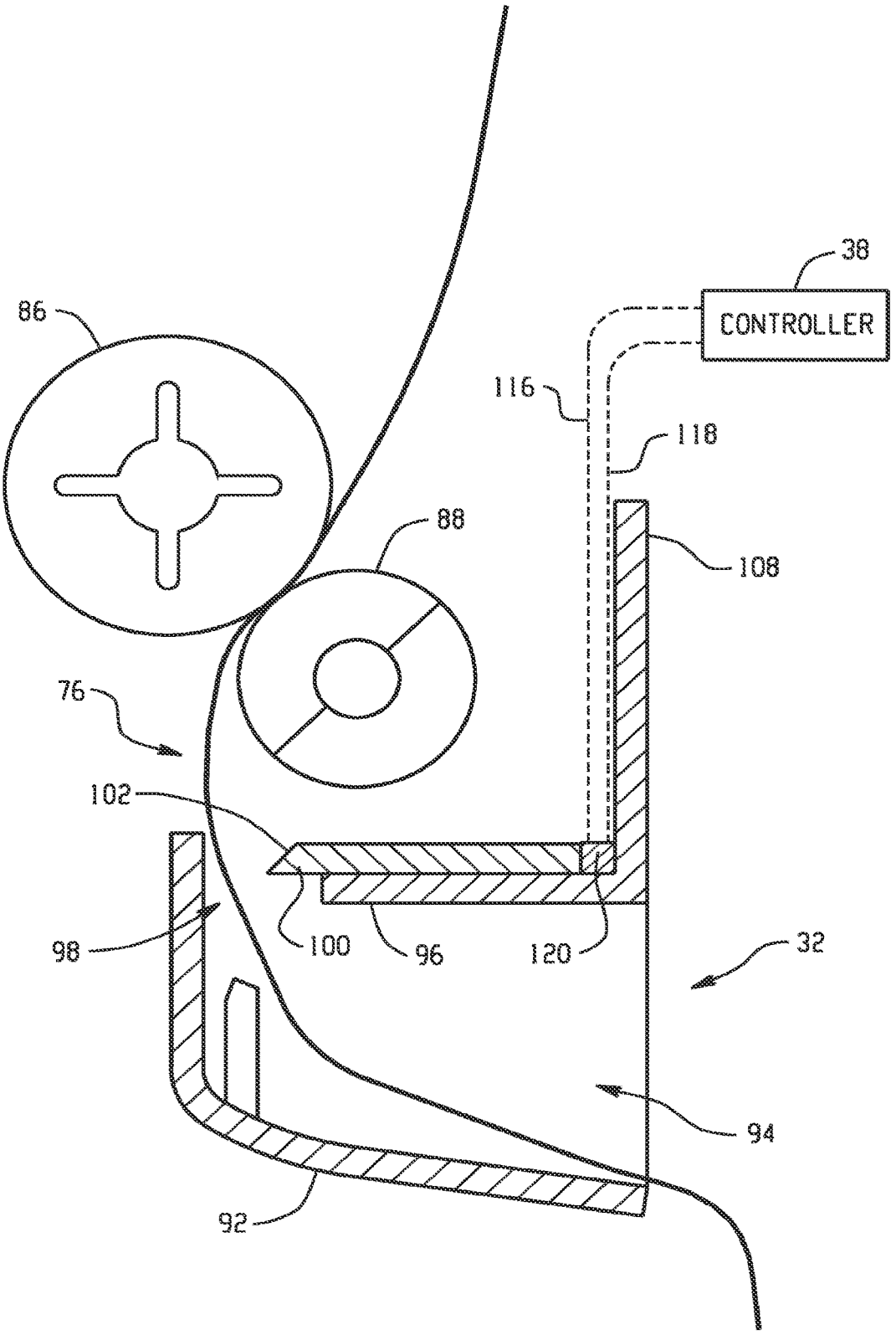
FIG. 8 is a partial side plan view illustration of the sheet product dispenser of FIG. 1 with an alternate embodiment tear bar and tear bar sensor.

An alternate embodiment tear bar assembly 76 is shown in FIG. 8. In this embodiment, a tear bar 100 is slidably coupled to the housing projection 96. As discussed above, the tear bar 100 and projection 96 may coupled in any suitable manner that allows the tear bar 100 to move over a limited range, such as a slot and bolted connection for example. In the exemplary embodiment, the sliding plane is parallel to the surface of projection 96, however, the claimed invention should not be so limited. The tear bar 100 includes an edge 102 that is positioned adjacent to the path of the sheet product 26 entering the opening 98.

A piezoelectric sensor 120 is coupled between the side of the tear bar 100 opposite the edge 102, and the wall 108. In the exemplary embodiment, the piezoelectric sensor 120 is not attached to the projection 96, allowing the piezoelectric sensor 120 to be compressed as discussed in more detail below. The piezoelectric sensor 120 deforms elastically when compressed and returns the tear bar 100 to its original position once the load is removed. In the exemplary embodiment, the direction of compression is in the plane that the tear bar 100 slides.

The piezoelectric sensor 120 is generally a low cost thick film having an analog voltage signal output. In one embodiment, the piezoelectric sensor 120 comprises a thin piezoelectric PVDF film laminated to a flexible planar substrate. The piezoelectric sensor 120 has a physical attribute that allows it to self-generate an electrical signal when compressed. The magnitude of the electrical signal is in proportion to the mechanical deformation of the sensor. An advantage of a piezoelectric sensor 120 is that it generates a voltage signal in relation to the magnitude of the compression and does not depend on closing electrical contacts. A pair of electrical conductors 116, 118 couples the piezoelectric sensor 120 to the controller 38. The analog voltage signal can be filtered for voltage amplitude or frequency by the controller 38. Frequency filtering can remove signals due to vibration.

During operation, the sheet product dispenser 20 activates and dispenses sheet product 26 to a user, such as in response to a signal from the proximity sensor 36 for example. Once the user receives a sufficient amount of sheet product 26, the user pulls on the sheet product 26 causing the sheet product 26 adjacent opening 98 to engage the tear bar edge 102. This contact by the sheet product 26 against the tear bar 100 causes a small deformation of the piezoelectric sensor 120 as the sheet product 26 is separated from the sheet product roll 72, 70. The deformation creates a voltage signal that is transmitted over the electrical conductors 116, 118 to main controller 38. Upon receiving the voltage signal from piezoelectric sensor 120, the main controller 38 may infer that the sheet product 26 has been separated and that the dispensing cycle has been completed. As discussed above, the main controller 38 may be configured in several ways, such as stopping the feed roller 86 immediately upon activation of the tear bar 100 for example. Alternatively, the main controller 38 may operate for a short period of time until the leading edge of the sheet product 26 is adjacent the opening 94 for example.

Figure 9:
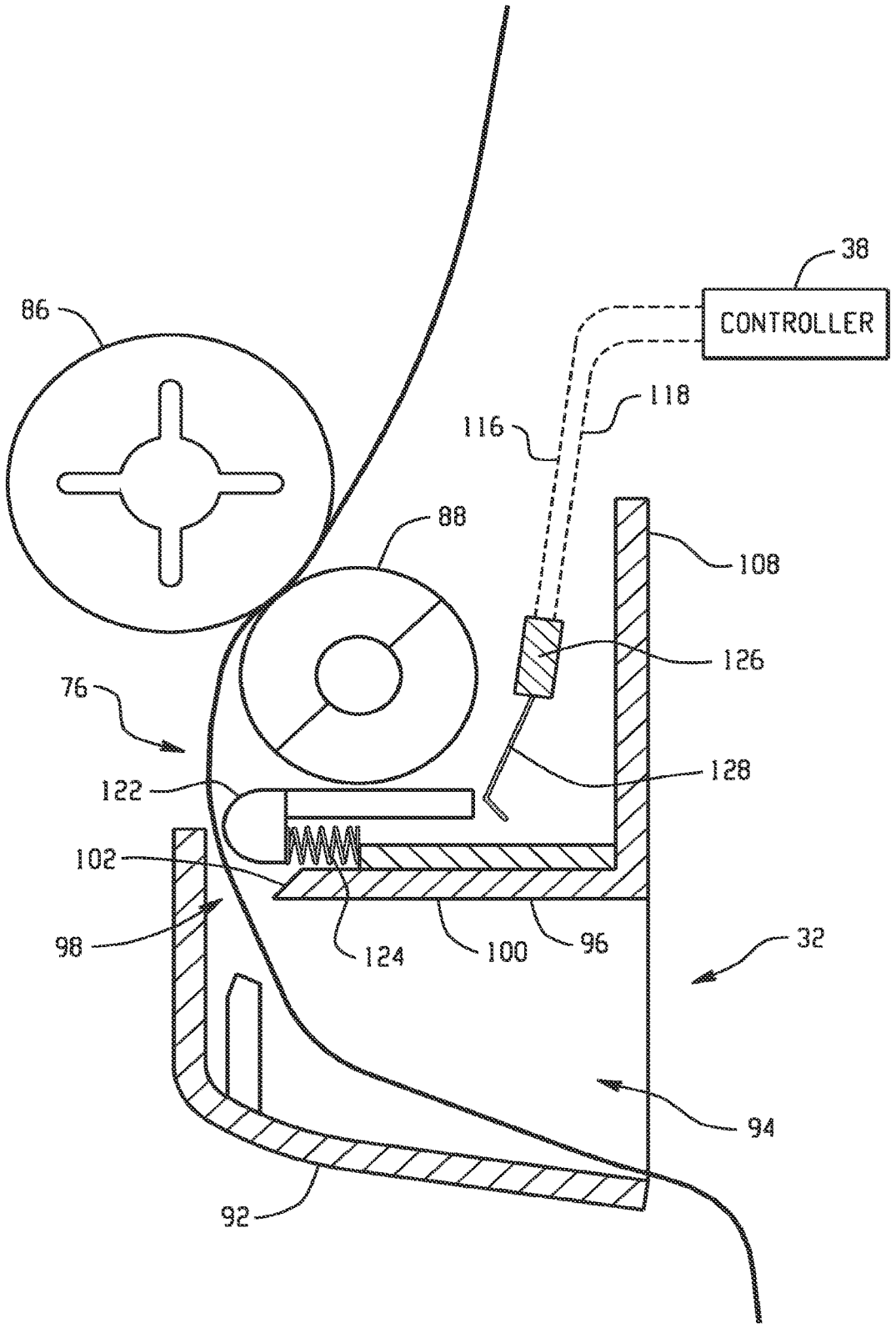
FIG. 9 is a partial side plan view illustration of the sheet product dispenser with another alternate embodiment tear bar and tear bar sensor.

Another alternate embodiment is illustrated in FIG. 9. In this embodiment, a sheet guide 122 is arranged adjacent the opening 98. The sheet guide 122 includes a smooth curved portion 124 that is positioned in the path of the sheet product 26. The sheet guide 122 is slidably coupled to the front cover 22 to allow motion in a plane generally parallel to the tear bar 100. The tear bar 100 is integrated with the housing projection 96. The tear bar edge 102 is positioned adjacent to the opening 98. It should be appreciated that while the tear bar 100 is illustrated as being integrated into the housing projection 96, a separate tear bar may alternately be mounted to the projection 96. In this alternate arrangement, the tear bar 100 would be fixedly coupled to the projection 96 so that there would be no relative motion.

A compression spring 124 is arranged between the sheet guide 122 and the housing wall 108. The spring 124 biases the sheet guide 122 towards the sheet product 26 traveling though the tear bar assembly 76. The spring 124 is sized to provide sufficient force on the sheet guide 122 to prevent deflection, or at least a large deflection, of the sheet guide 122 during normal operation. However, the spring 124 is also sized to allow the deflection of the sheet guide 122 when the user pulls the sheet product 26. A switch 126, such as a microswitch for example, is arranged adjacent the sheet guide 122. The switch 126 includes an arm 128 that is positioned adjacent the sheet guide 122. As will be discussed below, the arm 128 is positioned allow activation of the switch 126 in response to movement of the sheet guide 122.

The curved portion of sheet guide 122 is arranged to guide the sheet product 26 as it is dispensed from the sheet product dispenser 20 into the dispensing slot 32. The curved portion of sheet guide 122 further maintains a gap between the sheet product 26 and the tear bar edge 102. This gap helps prevent contact of the edge 102 by the sheet product 26 that may cause inadvertent or premature separation of the sheet product 26. During operation, the sheet product dispenser 20 activates and dispenses sheet product 26 to a user, such as in response to a signal from the proximity sensor 36 for example. The sheet product 26 slides over the sheet guide 122 and into the dispenser slot 32. Once the user receives a sufficient amount of sheet product 26, the user pulls on the sheet product 26 causing the spring 124 to compress and sheet guide 122 to deflect. Once the sheet guide 122 has deflected a sufficient amount, the sheet product 26 adjacent opening 98 engages the tear bar edge 102 causing the sheet product 26 to separate from the sheet product rolls 70, 72.

The deflection of the sheet guide 122 also results in a deflection of the arm 128 and activation of the switch 126. The switch 126 sends an electrical signal over electrical conductors 116, 118 to main controller 38. Upon receiving the voltage signal from switch 126, the main controller 38 may infer that the sheet product 26 has been separated and that the dispensing cycle has been completed. As discussed above, the main controller 38 may be configured in several ways, such as stopping the feed roller 86 immediately upon activation of the tear bar 100 for example. Alternatively, the main controller 38 may operate for a short period of time until the leading edge portion 90 of the sheet product 26 is adjacent the opening 94 for example. If should be appreciated that while the embodiment illustrated in FIG. 9 shows a switch, any type of sensor that is capable of detecting movement of the sheet guide 122 may be used. For example, the piezoelectric sensor 120 discussed herein may also be used.

Figure 10:
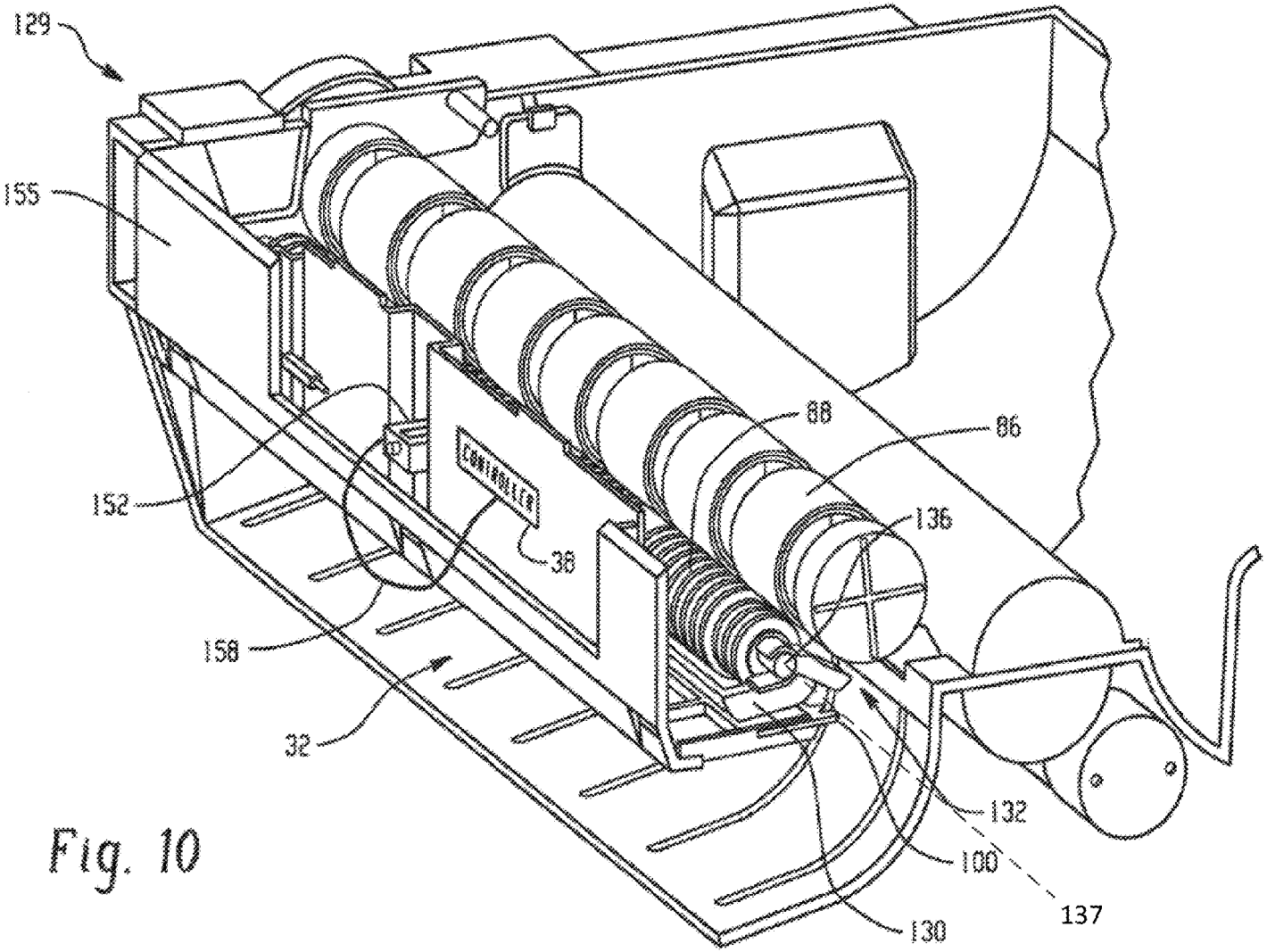
FIG. 10 is a partial perspective view illustration of the sheet product dispenser of FIG. 1 with another alternate embodiment tear bar sensor.
Figure 11:
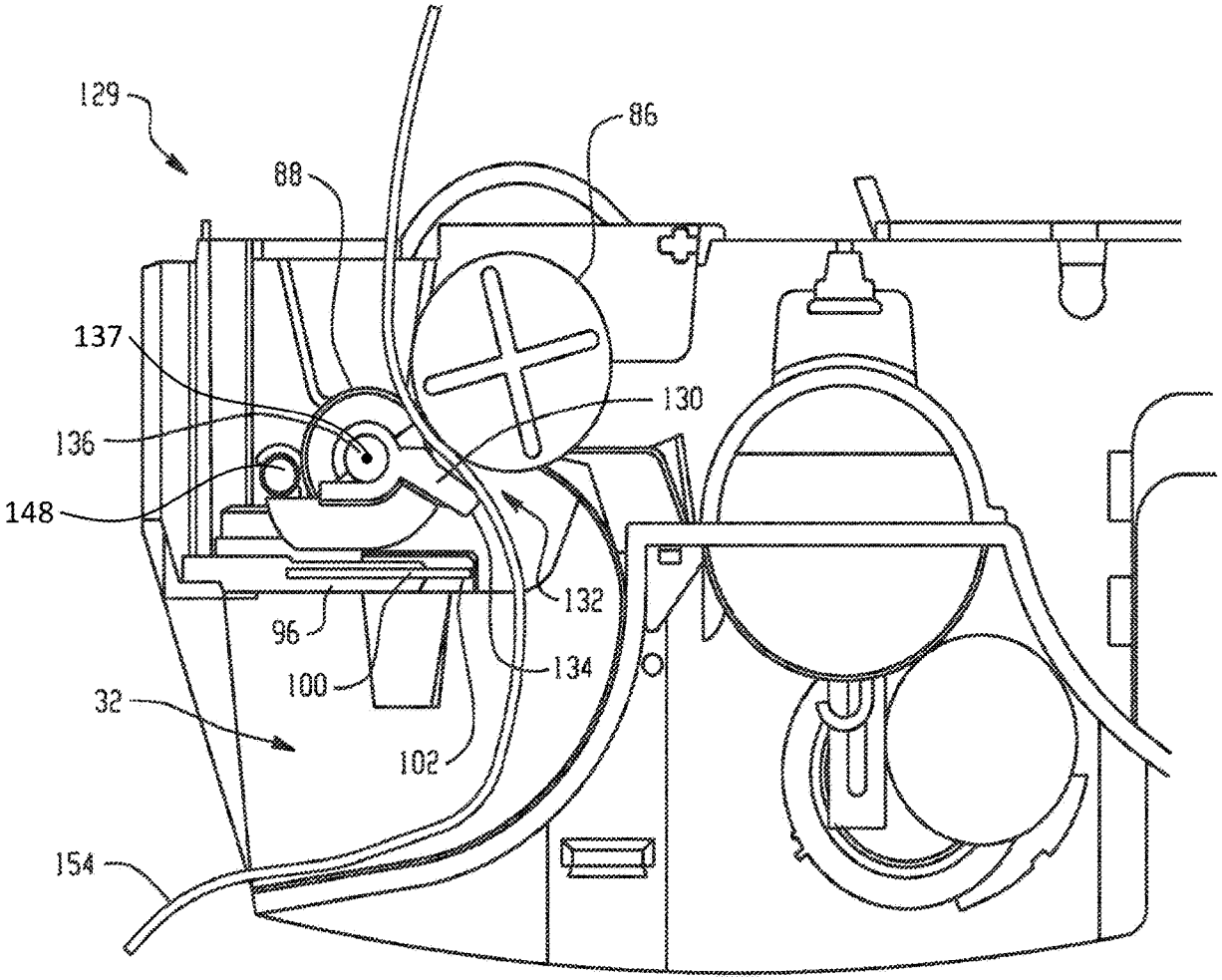
FIG. 11 is a partial side plan view illustration of the sheet product dispenser of FIG. 1 with the tear bar sensor of FIG. 10; and, FIG. 12 is a partial exploded view illustration of the sheet guide assembly of FIG. 10.
Figure 12:
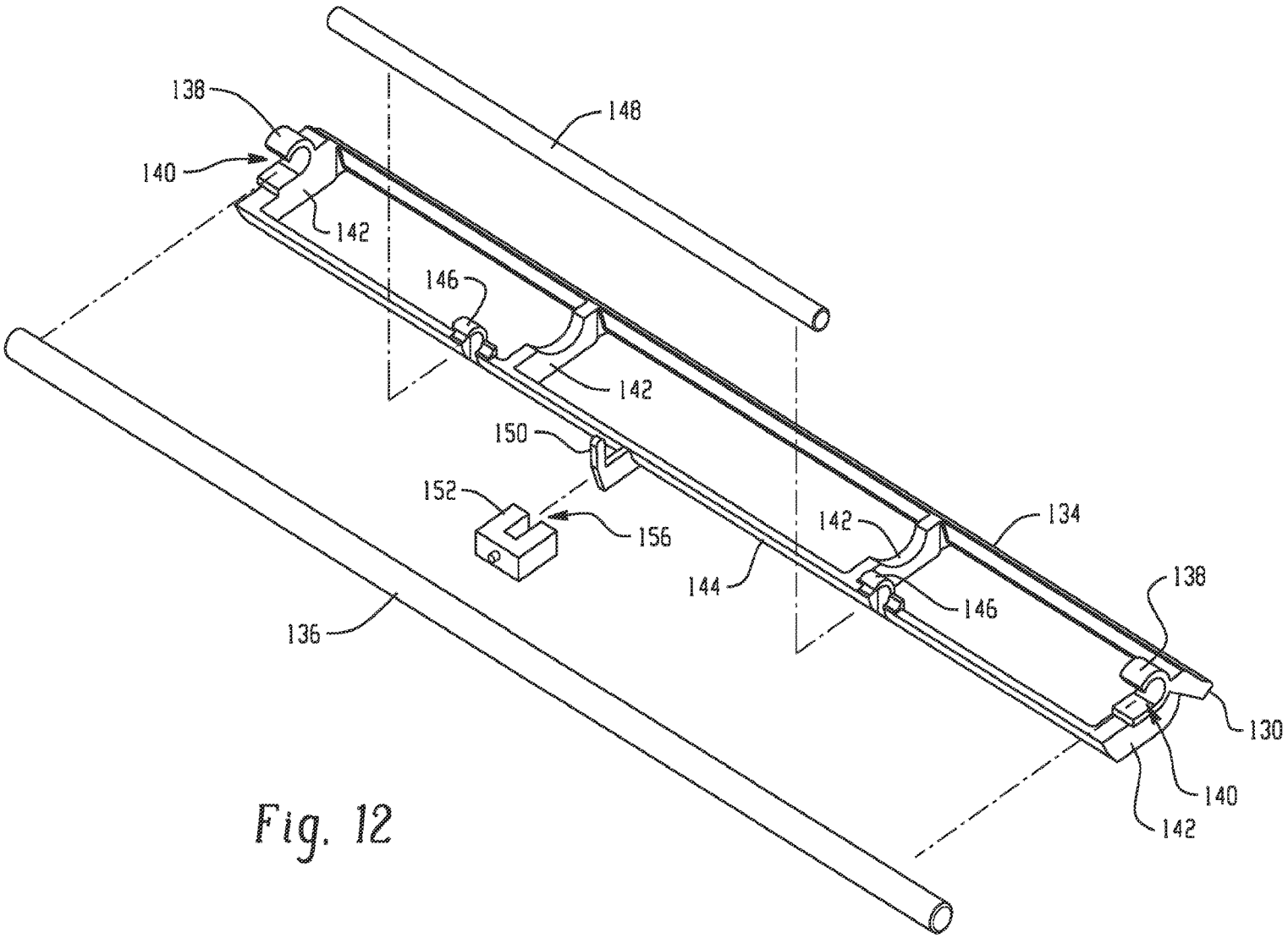

Another alternate embodiment sheet product dispenser 129 is illustrated in FIGS. 10-12. In this embodiment, a sheet guide 130 is arranged adjacent an opening 132. The sheet guide 130 includes a smooth curved portion 134 that is positioned in the path of the sheet product 26. The curved portion 134 extends substantially across the width of the dispensing slot 32. The sheet guide 130 is rotatably coupled to a pinch roller shaft 136 by a pair of projections 138 to allow the sheet guide 130 to rotate about axis 137. In the exemplary embodiment, the projections 138 include an openings 140 that allows the projections 138 to couple to the pinch roller shaft 136, such as by a snap fit for example. A plurality of arms 142 extends from the curved portion 134 connecting the curved portion 134 with a body portion 144. The body portion 144 includes a pair of projections 146 that are sized to receive a weight member 148. A sensor projection 150 also extends from the body portion 144. As will be discussed in more detail below, the sensor projection 150 cooperates with an optical sensor 152 to generate signal when the sheet guide 130 is moved, such as when sheet product 154 is dispensed.

The sheet guide 130 with the weight member 148 attached is arranged such that the center of gravity of the assembly is between the weight member 148 and the pinch roller shaft 136. This biases the sheet guide 130 to rotate such that the curved portion 134 moves towards the opening 132. As will be discussed in more detail below, when sheet product 154 is pulled by a user, the sheet guide 130 will rotate about axis 137 away from the opening 132. Once the sheet product 154 is dispensed, the sheet guide 130 rotates about axis 137 back to the initial position under the bias caused by the mass of weight member 148. It should be appreciated that an elastic member, such as a spring for example, may also generate the biasing force.

Adjacent the sheet guide 130, a tear bar 100 coupled to the housing projection 96. The tear bar edge 102 is positioned adjacent to the opening 98. It should be appreciated that while the tear bar 100 is illustrated as being separate from housing projection 96, the tear bar may alternately be integral with the projection 96.

The optical sensor 152 is mounted to the housing 155 and is electrically coupled to the main controller 38. In the exemplary embodiment, the optical sensor 152 is generally u-shaped having a slot 156 sized to receive the sensor projection 150. In the embodiment shown in FIGS. 10-12, the optical sensor 152 is a self-contained sensor having both an optical transmitter, such as an LED for example, and an optical receiver. The transmitter and receiver are arranged such that sensor light from the transmitter is continuously directed and received by the receiver. The optical sensor 152 is arranged to generate a signal in response to the interruption of the sensor light such as when the sensor projection 150 is rotated through the slot 156. It should be appreciated that other types of sensors may also be used to detect the motion of sheet guide 130. A microswitch, or a non-integrated optical sensor for example, may determine the rotation of the sensor projection 150.

During operation, a user activates the sheet product dispenser 129, such as by proximity sensor 36 described above. The dispenser 129 then dispenses sheet product 154 by rotating the feed roller 86 and the pinch roller 88 causing the sheet product 154 to pass through the opening 132 and out of dispensing slot 32. Once the user receives a sufficient amount of sheet product 154, the user pulls on the sheet product 154 causing the sheet guide 130 to rotate about the pinch roller shaft 136 (i.e., to rotate about axis 137). The rotation of the sheet guide 130 about axis 137 causes the sensor projection 150 to move into the slot 156 interrupting the sensor light on the optical sensor 152.

When the sensor projection 150 interrupts the sensor light, the optical sensor 152 sends an electrical signal over a conductor 158 to main controller 38. Upon receiving the voltage signal from optical sensor 152, the main controller 38 may infer that the sheet product 154 has been separated and that the dispensing cycle has been completed. As discussed above, the main controller 38 may be configured in several ways, such as stopping the feed roller 86 immediately upon activation of the sheet guide 130 for example. Alternatively, the main controller 38 may operate for a short period of time until the leading edge of the sheet product 154 is adjacent the dispensing slot 32 for example.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, front, rear, top, bottom etc, do not denote any orientation, order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A sheet product dispenser for dispensing a sheet product disposed therein, comprising:

a roller assembly configured to advance the sheet product for dispensing, the roller assembly comprising at least one roller having a shaft;

a movable member rotatably coupled to the shaft of one of the at least one rollers and configured to interact with the sheet product, the movable member being rotatable about an axis from a first position to a second position when the sheet product is pulled by a user;

a biasing member operably coupled to the movable member, the biasing member providing a biasing force to return the movable member to the first position after the sheet product is pulled by the user, wherein the biasing member comprises a weight member or an elastic member;

an optical sensor configured to generate a signal in response to interruption of a path of light transmitted by an optical transmitter, wherein the path of light is interrupted by the movable member or a projection extending from a body portion of the movable member when the movable member is in the second position; and a tear bar having an edge for tearing the sheet product when the sheet product is pulled by the user, the tear bar being distinct from the movable member.

2. The dispenser of claim 1, wherein, in response to the signal, the dispenser is configured to advance the sheet product beyond an opening in a housing of the dispenser such that the sheet product is exposed for pulling by a future user.

3. The dispenser of claim 1, wherein the weight member is offset from the axis, such that a center of gravity of the movable member and the weight member is between the shaft of the at least one roller and the weight member.

4. The dispenser of claim 1, wherein the optical transmitter is configured to continuously direct the path of light to a receiver.

5. The dispenser of claim 1, wherein:

the optical sensor comprises a slot sized to receive the projection extending from the body portion of the movable member, and the sensor is configured to generate the signal when the movable member is rotated to the second position and the projection interrupts the path of light within the slot.

6. The dispenser of claim 1, wherein the shaft of one of the at least one roller is a pinch roller shaft.

7. The dispenser of claim 1, further comprising:

a housing having a sheet dispensing opening, wherein the tear bar is positioned in a path of the sheet product between the opening and the movable member.

8. The dispenser of claim 7, wherein the optical sensor is coupled to the housing.

9. The dispenser of claim 1, wherein the movable member comprises:

a surface on one side of the axis, the surface being configured to contact the sheet product; and a body portion positioned on a side of the axis opposite the surface, the body portion having the projection extending therefrom.

10. A method of dispensing a sheet product from a dispenser, comprising:

providing a dispenser which comprises a movable member rotatably coupled to a roller assembly, the roller assembly comprising at least one roller having a shaft, the movable member being rotatably coupled to the shaft of one of the at least one rollers, the movable member being configured to interact with the sheet product, the movable member being rotatable about an axis from a first position to a second position when the sheet product is pulled by a user, a biasing member operably coupled to the movable member, the biasing member comprising a weight member or an elastic member, and a tear bar having an edge for tearing the sheet product when the sheet product is pulled by the user, the tear bar being distinct from the movable member;

sensing, via an optical sensor, an interruption of a path of light transmitted by an optical transmitter, wherein the path of light is interrupted by the movable member or a projection extending from a body portion of the movable member when the movable member rotates to the second position; and returning the movable member to the first position via a biasing force provided by the biasing member, after the sheet product is pulled by the user.

11. The method of claim 10, further comprising:

generating a signal in response to the sensing, the signal indicating when the sheet product is pulled by the user; and in response to the signal, advancing the sheet product beyond an opening in a housing of the dispenser, such that the sheet product is exposed for pulling by a future user.

12. The method of claim 11, wherein:

the optical sensor comprises a slot sized to receive the projection extending from the body portion of the movable member, and the signal is generated when the movable member is rotated to the second position and the projection interrupts the path of light within the slot.

13. The method of claim 10, wherein the weight member is offset from the axis, such that a center of gravity of the movable member and the weight member is between the shaft of the at least one roller and the weight member.

14. The method of claim 10, wherein the optical transmitter is configured to continuously direct the path of light to a receiver.

15. The method of claim 10, wherein the shaft of one of the at least one roller is a pinch roller shaft.

16. The method of claim 10, wherein the dispenser further comprises:

a housing having a sheet dispensing opening, wherein the tear bar is positioned in a path of the sheet product between the opening and the movable member.

17. The method of claim 16, wherein the optical sensor is coupled to the housing.

18. The method of claim 10, wherein the movable member comprises:

a surface on one side of the axis, the surface being configured to contact the sheet product; and a body portion positioned on a side of the axis opposite the surface, the body portion having the projection extending therefrom.

* * * * *